United States Patent [19]

Payton

[11] 4,114,687

[45] Sep. 19, 1978

[54] SYSTEMS FOR PRODUCING BITUMEN FROM TAR SANDS

[75] Inventor: Joy T. Payton, Houston, Tex.

[73] Assignee: Texaco Inc., New York, N.Y.

[21] Appl. No.: 842,123

[22] Filed: Oct. 14, 1977

[51] Int. Cl.[2] ..... E21B 43/04; E21B 43/08; E21B 43/24

[52] U.S. Cl. ..... 166/51; 166/57; 166/303; 166/276; 166/222

[58] Field of Search ..... 166/51, 57, 272, 157, 166/158, 222, 276, 278, 312, 303; 299/16, 17, 5

[56] References Cited

U.S. PATENT DOCUMENTS

| | | | |
|---|---|---|---|
| 2,349,062 | 5/1944 | Uren | 166/278 |
| 2,720,381 | 10/1955 | Quick | 166/312 |
| 2,745,647 | 5/1956 | Gilmore | 299/5 |
| 2,881,838 | 4/1959 | Morse et al. | 166/303 |
| 2,906,338 | 9/1959 | Shook | 166/278 |
| 2,941,594 | 6/1960 | Ladd et al. | 166/276 |
| 2,978,024 | 4/1961 | Davis | 166/278 |
| 3,393,736 | 7/1968 | Goodwin | 166/276 |
| 3,858,654 | 1/1975 | Walker | 166/303 X |
| 3,913,671 | 10/1975 | Redford et al. | 166/272 |
| 3,951,457 | 4/1976 | Redford | 299/5 |

*Primary Examiner*—Stephen J. Novosad
*Attorney, Agent, or Firm*—Carl G. Ries; Thomas H. Whaley; Theron H. Nichols

[57] ABSTRACT

A system for producing bitumen from unconsolidated tar sands in an open well includes a screen positioned in the well large enough to pass a majority of the formation sand and small enough to retain a gravel packing material, a pair of high pressure fluid lateral nozzles fracturably fastened in the bottom of the screen, a wash pipe extending down into the screen for detachably connecting to the nozzles and for washing out a cavity in the tar sand formation, a ball weight for dropping down the wash pipe for knocking the nozzles out of the bottom of the screen for allowing a consolidated gravel pack material to emerge from the screen bottom and form the gravel pack on the screen, and the wash pipe being replaceable with a production tube packed off at the screen mid point for allowing hot aqueous fluids to flow from a screen annulus formed between the production tube and the screen into the cavity for producing oil.

8 Claims, 7 Drawing Figures

10
11
12
13
15
16
17
18
19
21 – HIGH PRESSURE HOT AQUEOUS FLUIDS
22 – HOT FLUIDS, BITUMEN & SAND
23
24

10
11
12
13
14
15
16
16a
18
20
TAR SANDS OR VERY LOOSE AND UNCONSOLIDATED FORMATION

OIL OR BITUMEN
HOT AQUEOUS FLUIDS
30
31
19
10
11
12
13
15
16
16a
26a
30a
24

OIL
28
29
10
11
12
13
15
16
16a
26a

SYSTEMS FOR PRODUCING BITUMEN FROM TAR SANDS

BACKGROUND OF THE INVENTION

Unconsolidated formations where heavy oil or tar is the matrix have hindered the production in oil wells as well as water wells ever since wells have been drilled. Early assumptions were that the sand in the oil had to be lived with. Curtailed producing rates were sometimes used to alleviate sand production.

The problem in tar sands is the undesirable production of sand with the oil or bitumen which is detrimental to most equipment, and particularly to the pumps.

Unconsolidated or poorly consolidated sands or formations are a significant problem to a great degree, particularly in Canada, Texas, Louisiana, and California, on both land and offshore. Sanding is a problem all over the world from the Gulf of Mexico to Venezuela to Nigeria.

Different methods for controlling the migration of sand from unconsolidated formations or tar sands are screens, gravel packs, or agglomerating the formation in place with chemicals. The instant disclosure utilizes a new combination of the above.

U.S. Pat. No. 3,379,247 circulates hot fluids between lower and upper perforations in a tar sand formation, but is also produces sand with the melted bitumen which is detrimental to most mechanical equipment above, as the hydraulic pumps, etc. Assignee's U.S. Pat. No. 3,913,671 discloses circulating an aqueous heating fluid with sodium hydroxide out upper performations and in lower perforations after packing through a sand pack. But this disclosure lacks the steps of running a wash pipe through the screen with a nozzle on lower end thereof and breaking off the nozzle for enlarging the screen opening among other structural features for providing an improved system of sand control and production of bitumen. U.S. Pat. No. 2,905,245 likewise lacks the screen and gravel pack therewith for providing the disclosed improved method for hydrocarbon production in tar sands. U.S. Pat. No. 3,910,351 discloses a pile of granular material around a slotted tube in a cavity, but the granular material fills the cavity completely with no provision for penetration by a screen. U.S. Pat. No. 3,812,913 shows a different method of formation consolidation wherein a bonding agent is applied to the formation.

OBJECTS OF THE INVENTION

Accordingly, a primary object of this invention is to provide an improved system for producing petroleum such as bitumen from a subterranean reservoir of very viscous, semi-solid, immobile hydrocarbon material, such as tar sands, that is economical, practical, and provides uninterrupted and continuous recovery of petroleum from the formation.

Another object of this invention is to provide an improved system for sand control in an open hole type of completion extending into a subterranean reservoir of tar sands, that is economical, practical, and reliable.

A further object of this invention is to provide a system for producing bitumen from tar sands that is easy to operate, comprises a simple structure, is economical to utilize and operate, and is of greater efficiency for the production of hydrocarbons.

Other objects and various advantages of the disclosed process for producing bitument from tar sands will be apparent from the following detailed description, together with the accompanying drawings, submitted for purpose of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one embodiment for carrying out the system for producing bitumen from tar sands wherein like reference numerals have been employed to indicate similar parts in the several views in which.

The invention disclosed herein, the scope of which being defined in the appended claims, is not limited in its application to the details of construction and arrangement of parts shown and described, since the invention is capable of other embodiments and systems and of being practiced or carried out in various ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE SYSTEM

This invention comprises at least one system for producing bitumen from tar sands.

A SYSTEM FOR PRODUCING BITUMEN FROM TAR SANDS

A system is disclosed for producing bitumen from a subterranean reservoir of tar sands, as unconsolidated oil bearing sands from a well having a casing extending down to the tar sand formation.

Figures 1, 2:
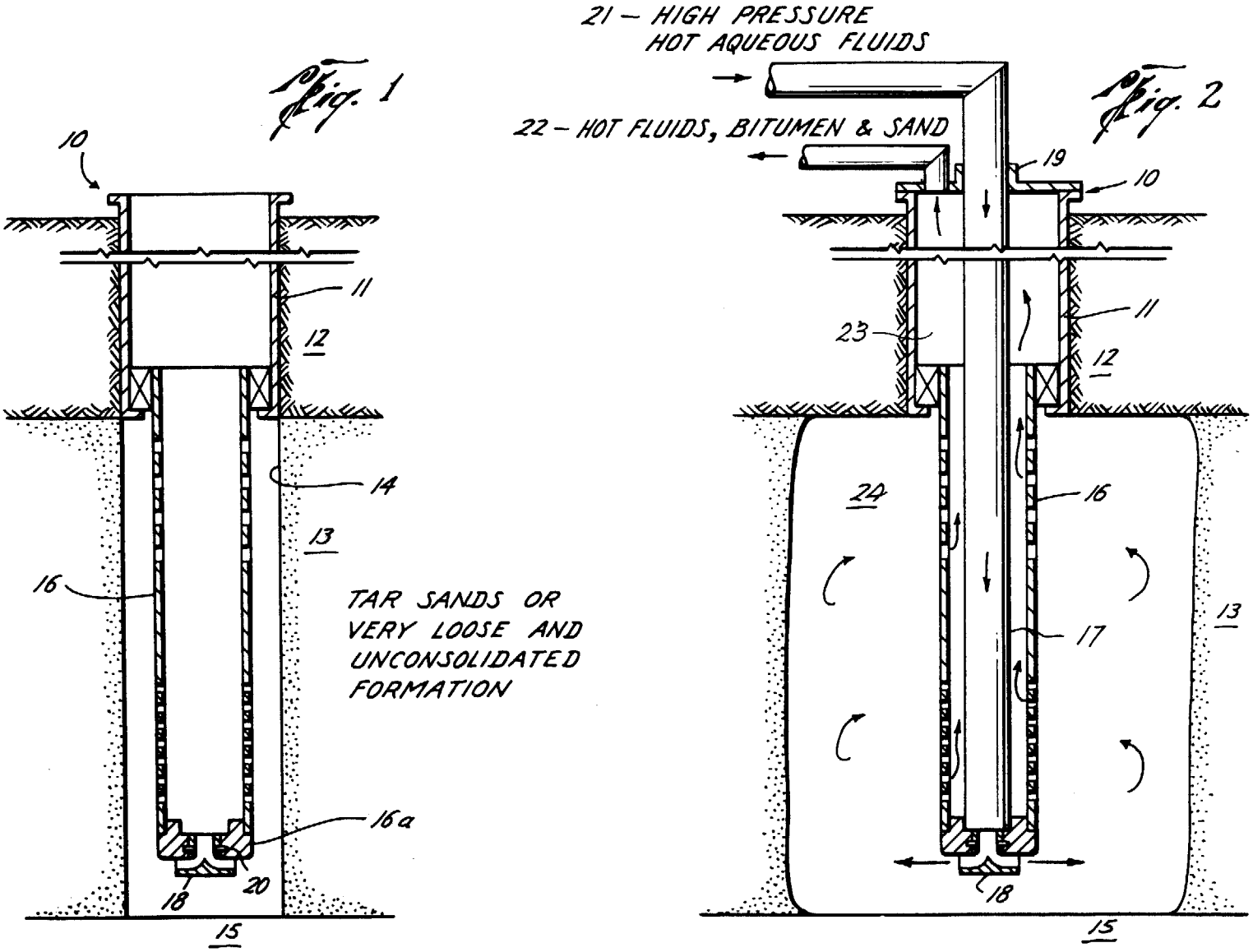
FIG. 1 is a schematic vertical sectional view of a well through a subterranean reservoir of tar sands illustrating one of the first steps of setting a screen in the open hole down through the tar sand formation to the bottom thereof and packing it off against the casing.
FIG. 2 is the well of FIG. 1 after a wash pipe has been run through the screen for connecting to a nozzle at the screen bottom.

FIG. 1 discloses a well 10 having a casing 11 extending down through the usual shale formation 12 for example to a tar sand formation 13, which open hole well portion 14 in the formation is drilled down to bedrock 15. A preferred mechanism for washing out or forming a cavity in the well through the unconsolidated oil bearing or tar sand formation comprises the following elements. A liner screen 16, wash pipe 17, FIG. 2, and a hydraulic double nozzle 18, FIG. 1, for example, which has two 180° oppositely positioned openings for ejecting high velocity fluids horizontally and is rotatable about bearing housing 19, FIG. 2. The nozzle is connected to a cap 16*a* on the bottom of the screen 16 with two or more shear pins 20, FIG. 1, for example. The top of the screen 16 is packed off against the bottom of the casing and extends down through the tar sand or unconsolidated petroliferous formation 13 to the bedrock for example. This screen is large enough to pass a majority of the formation sand and small enough to retain a gravel packing material.

Figure 3A:
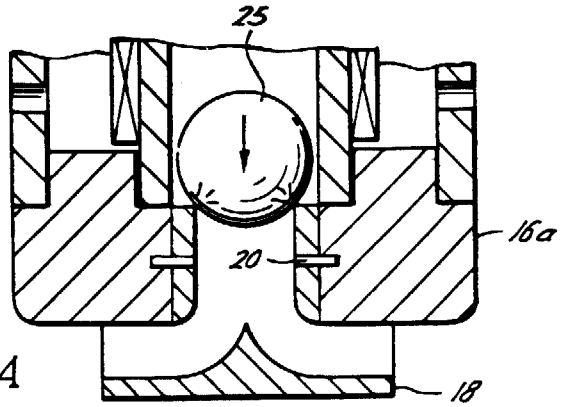
FIG. 3A is the well of FIG. 2 after the cavity has been washed out with a horizontal nozzle and a weight is dropped to break away the nozzle.
Figure 3B:
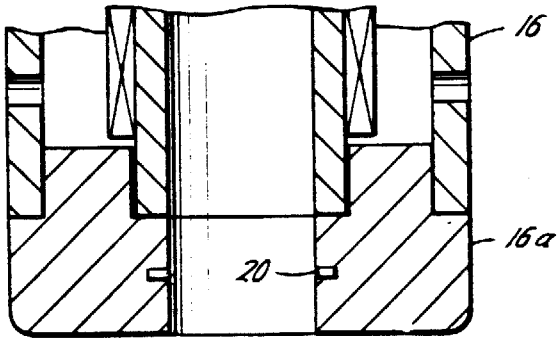
FIG. 3B is the well of FIG. 3A with the nozzle broken out for ejecting a consolidated gravel pack material.

Following packing of the screen in the open hole, a wash pipe 21, FIG. 2, is lowered internally of the screen 16 to connect to the bottom of the screen and accordingly to the double nozzle 18. The high pressure fluid supply wash pipe 17 extends from a suitable source 21 on the surface of high pressure, high velocity hot aqueous fluids, as hot water, down through the well 10 to the cap 16*a* and the hydraulic double nozzle 18. Nozzle 18 has two 180° oppositely positioned openings for ejecting the high velocity fluids horizontally and is rotatable about bearing housing 17. Thus as the double nozzle ejects hot and high pressure, high velocity fluid in the tar sand formation immediately under the lower end of the casing, the nozzle is slowly rotated and lowered until reaching the lowermost, bedrock position illustrated in FIG. 2. Immediately upon ejection of the hot fluids from the nozzle, a slurry 22 of spent fluids, sand, and bitumen are washed out, pass through the screen and then up the annulus 23 in the well formed between the wash pipe and the well walls to exhaust through a conduit at the surface where the bitument is recovered therefrom. After a cavity 24, FIG. 2, is formed, the double nozzle 18 is removed by dropping a weight 25 down the wash pipe to shear pins 20, FIG. 3A, to knock the nozzle out of the cap 16*a* in the bottom of the wash pipe and screen.

A predetermined amount of consolidating graded gravel pack slurry 26, substantially equivalent to the amount of sand and bitumen removed when forming the cavity, is then measured out. Without stopping the flow of fluid into the well, a stream of the consolidating gravel pack slurry 26 is pumped down into the cavity 24 from out the bottom of the cap 16*a* and the wash and packing materials supply pipe 17. The gravel pack slurry circulates up and around in the cavity 24 to deposit on the screen 16 forming the consolidated gravel pack 26*a*. The liquid portion of the slurry 16 passes through the screen and up the annulus 23 to exit from pipe 27 at the surface.

Figure 4:
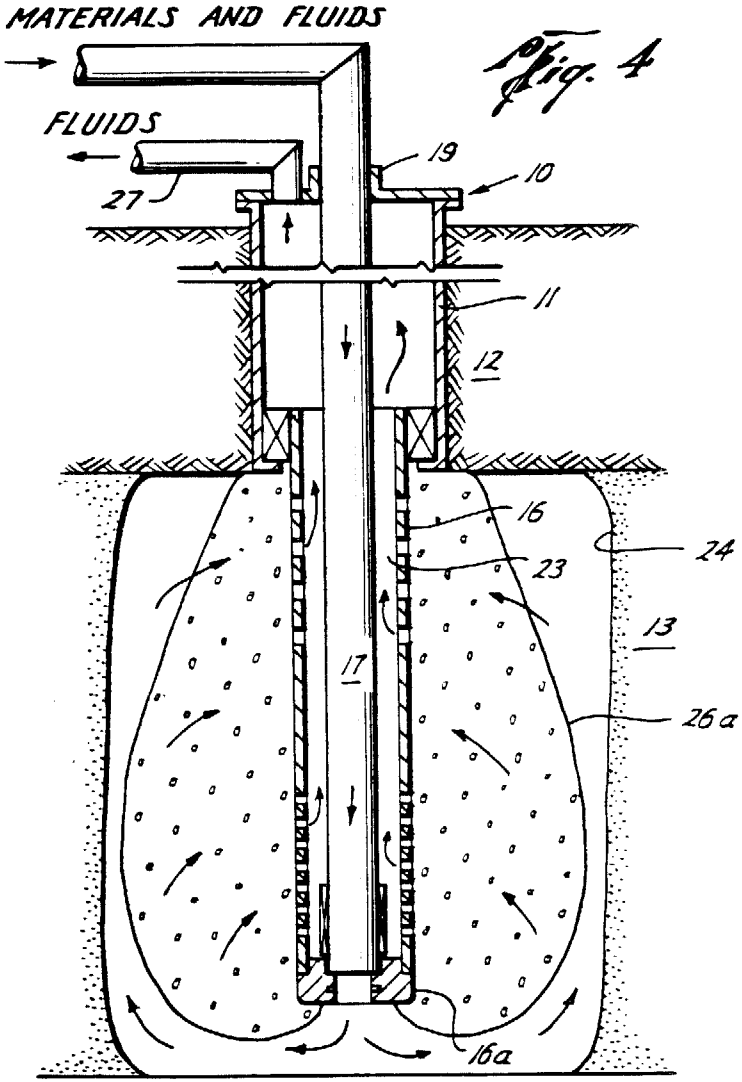
FIG. 4 illustrates injection of the consolidated gravel pack material.
Figure 5:
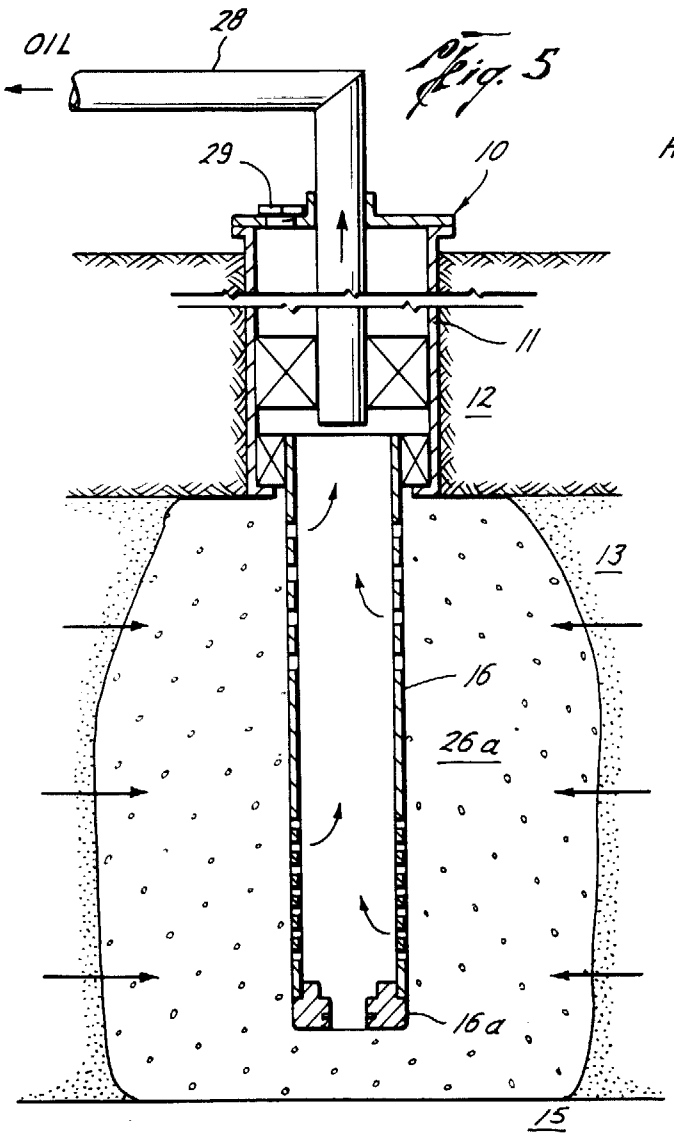
FIG. 5 illustrates the well producing primary crude oil.

The wash pipe 17, FIG. 4, is then removed and replaced with an oil outlet pipe 28, FIG. 5, packed in the casing 11. Exit pipe 27, FIG. 4, is removed and the opening on top of the well sealed with a cap 29, FIG. 5. Primary oil then flows through gravel pack 26*a* and into screen 16 for passage through the oil outlet pipe 28 to the surface for gathering and/or storage.

Figure 6:
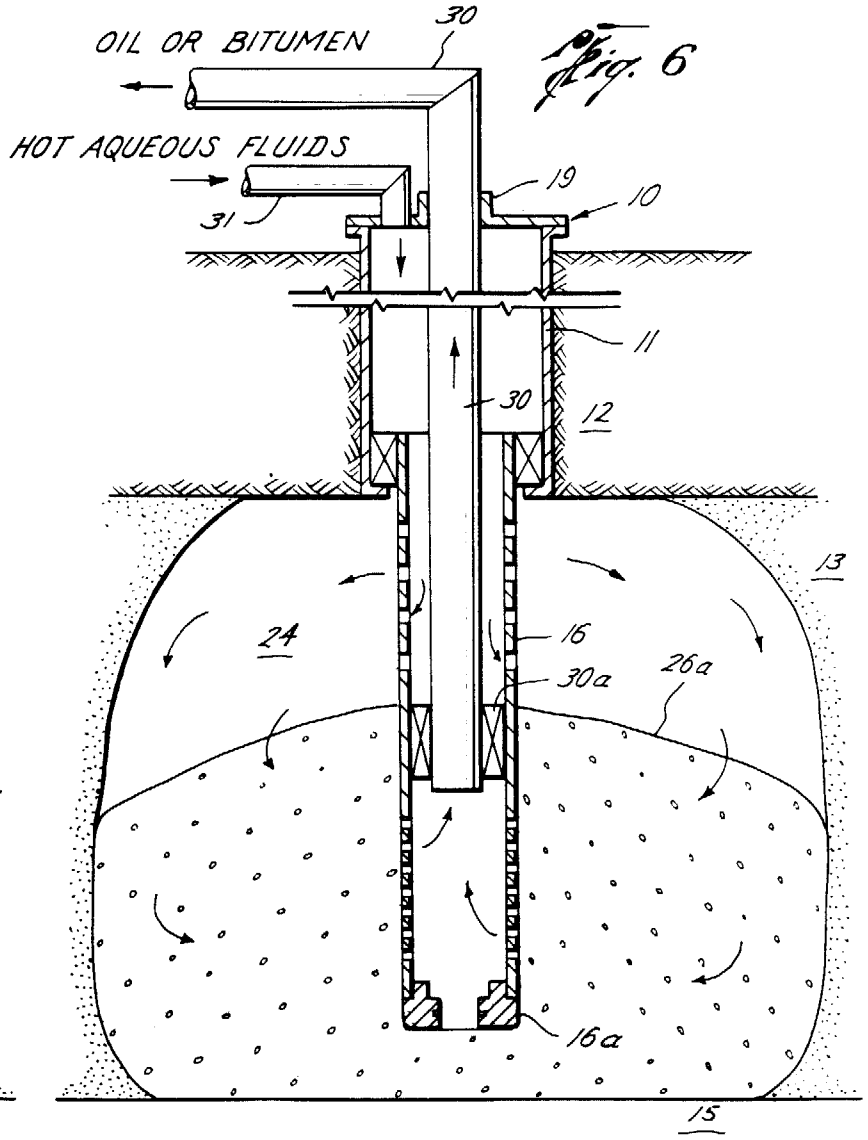
FIG. 6 illustrates a gravel pack in the well consolidated around the screen by various consolidating materials as hot aqueous fluids, a jell, or other consolidating chemicals for secondary recovery production.

When the primary oil ceases to flow, secondary recovery is required for continued oil production. Production tubing 30, FIG. 6, is then substituted for the oil outlet pipe 28, FIG. 5, and packed off midway down the screen 16 with packer 30*a* so that oil entering the lower half of the screen may flow, as by being pumped, up through the production tubing 30 to the surface for gathering and/or storage. An injection tube 31 is inserted in the opening formerly closed by cap 29 for injecting secondary recovery fluids, such as hot aqueous fluids including steam, either saturated or superheated, or hot water, etc.

Accordingly, in configuration of FIG. 6, the high pressure hot aqueous fluids are supplied from a suitable source on the surface for passing through injection tube 31 to the well casing 11 and annulus between the screen and production tubing, through the upper perforated portion of the screen above the packer 30*a* through which the hot fluids are ejected into the well cavity 24 for first spreading the gravel pack out and below the level of the packing 30*a*. Then the hot aqueous fluids melt and flow the melted bitumen and tar sands from the tar sand formation through the gravel pack 26*a* toward the screen 16. Only the melted bitumen and wash fluids pass through the gravel pack and screen, to the production tube for passing up through the production string 30 to the collection tank at the surface.

A typical formation with the completed consolidated gravel pack 26*a* is illustrated in FIG. 6 for a 2-inch (5.08 cm) diameter production tube. Here the oil bearing formation is 20 feet (6 meters) thick and the gravel pack 26*a* has a height of 6 feet (1.8 meters) and a radius of 15 feet (4.5 meters). The volume is about 4200 cubic feet (120 cubic meters).

In tar sand formations as unconsolidated oil bearing sands, the conventional gravel pack is required to be consolidated to prevent oil sand flow which results in low oil flow and provides too low oil flow for good commercial production. This invention overcomes this problem by consolidating the gravel pack.

In a modified system the gravel pack in FIG. 6 may be consolidated or congealed with a conventional jell.

Another modified system may utilize a gravel pack consolidated with a thermosetting plastic or resins, such as but not limited to, that disclosed in U.S. Pat. No. 3,297,086.

Accordingly, it will be seen that a system for producing butumen from tar sands has been described which will operate in a manner which meets each of the objects set forth hereinbefore.

While only a few systems of the invention have been disclosed, it will be evident that various other methods and modifications are possible without departing from the scope of the invention and it is accordingly desired to comprehend within the preview of this invention such methods and modifications as may be considered to fall within the scope of the appended claims.

I claim:

1. A system for forming a cavity in unconsolidated petroliferous formation sands for producing bitumen from a subterranean reservoir of tar sands as the unconsolidated petroliferous formation sands from an open well extending down in to the unconsolidated petroliferous sand formation comprising, (a) screen means positioned in the well large enough to pass a majority of the formation sand and small enough to retain a gravel packing material, (b) high pressure fluid lateral nozzle means releasable retractably secured for protrudance below said screen means, and (c) wash pipe means annularly releasably internally mounted within said screen means and connected to said high pressure fluid lateral nozzle means for washing out a cavity in the sand formation.

2. A system as recited in claim 1 wherein, (a) said high pressure fluid lateral nozzle means comprises a plurality of horizontal nozzles radiating from the center of the wash pipe below said screen means for washing out said cavity.

3. A system for producing bitumen from a subterranean reservoir of tar sands as unconsolidated petroliferous formation sands from an open walled well segment extending down in to the unconsolidated petroliferous sand formation comprising, (a) screen means positioned in the well segment large enough to pass a majority of the formation sand and small enough to retain a gravel packing material, (b) high pressure fluid lateral nozzle means releasably mounted on and protruding below said screen means, (c) high pressure fluid wash pipe means releasably removably annularly mounted in said screen means and connectable to said nozzle means for washing out a cavity in the sand formation, (d) said high pressure fluid wash pipe means being replaceable with a production tube means, (e) said production tube means being packable intermediate the ends of the screen for forming an annulus means in the well and screen means, and (f) said production tube means comprises means for ejecting a consolidating gravel packing material from the screen means upper portion above the packer into the cavity for forming the consolidated gravel pack around the screen means lower portion for improved production of bitumen from the consolidated petroliferous formation sands.

4. A system as recited in claim 3 wherein, (a) said production tube means comprises further means for circulating hot aqueous fluids from the screen means upper portion into the petroliferous formation for producing more sand-free bitumen from through the consolidated gravel pack into the screen means lower portion for recovery at the surface.

5. A system as recited in claim 3 wherein, (a) said high pressure fluid lateral nozzle means comprises a plurality of lateral nozzles radiating from the wash pipe below said screen means for washing out said cylindrical cavity for placement of said gravel pack therein.

6. A system as recited in claim 3 including further, (a) means for removing said high pressure fluid lateral nozzle means from said screen means comprising a weight for being pumped down said wash pipe for shearing said nozzle means from the bottom of the screen means.

7. A system as recited in claim 3, wherein, (a) said consolidating gravel packing material comprises a jelling gravel packing material for forming a congealed gravel pack around said screen means lower portion for maintaining said pack in position as bitumen is produced from the unconsolidated petroliferous formation sands.

8. A system as recited in claim 3 wherein, (a) said consolidating gravel pack material comprises a plastic packing material for forming said consolidated gravel pack around said screen means lower portion for insuring further production of sand-free bitumen from the subterranean reservoir of unconsolidated petroliferous sand formation.

* * * * *